US007375640B1

(12) United States Patent
Plost

(10) Patent No.: US 7,375,640 B1
(45) Date of Patent: May 20, 2008

(54) SYSTEM, METHOD AND IMPLEMENTATION FOR INCREASING A LIKELIHOOD OF IMPROVED HAND HYGIENE IN A DESIRABLY SANITARY ENVIRONMENT

(76) Inventor: Gerald N. Plost, 3459 S. Florence Pl., Tulsa, OK (US) 74105

( * ) Notice: Subject to any disclaimer, the term of this patent is extended or adjusted under 35 U.S.C. 154(b) by 234 days.

(21) Appl. No.: 10/963,155

(22) Filed: Oct. 12, 2004

(51) Int. Cl.
*G08B 13/14* (2006.01)

(52) U.S. Cl. ..... 340/573.1; 340/573.4; 340/870.16; 340/500; 340/572.1; 340/572.4; 340/572.7; 340/572.8

(58) Field of Classification Search ..... 340/573.1, 340/573.4, 870.16, 500, 572.1, 572.8, 572.4, 340/572.7; 4/236, 661
See application file for complete search history.

(56) References Cited

U.S. PATENT DOCUMENTS 6,577,240 B2 * 6/2003 Armstrong ..... 340/573.1
6,882,278 B2 * 4/2005 Winings et al. ..... 340/573.1
7,015,816 B2 * 3/2006 Wildman et al. ..... 340/573.1

* cited by examiner

*Primary Examiner*—Tai Nguyen
(74) *Attorney, Agent, or Firm*—Gable Gotwals

(57) ABSTRACT

A desirably sanitary environment such as a hospital will have hand hygiene stations dispersed in some of the patient rooms, hallways, common areas, staff bathrooms and the like. Workers entering and exiting these rooms and areas should comply with proper hand hygiene protocols as they move from contact with one patient to another. A system, method and implementation are provided for increasing the likelihood of proper hand hygiene protocols. Identifying credentials unique to each worker, sensors tracking the room entry and exit activities of each credential, electronic hand hygiene substance dispensers responsive to the credentials and a computerized network are combined to count completed hand hygiene protocol cycles to the credit of each credential for use in a compliance awards program to encourage proper hand hygiene. Each credential may include green, yellow and red LED's to alert as to "hands clean," please sanitize" and "hands dirty" conditions.

32 Claims, 7 Drawing Sheets

320

321 *HAND HYGIENE REPORT FOR MICU – AUGUST, 2004*

322 Total Number of Patient Room Entries: 8,197

323 Total Number of Completed Hand Hygiene Protocol Cycles: 7,109

324 Group Hand Hygiene Compliance: 86.7%

Hand Hygiene by Employee Number, ranked by % Completed Cycles

| Employee number (325) | Patient room entries (326) | Completed cycles (327) | % Completed cycles (328) |
|---|---|---|---|
| 485 | 976 | 956 | 98 |
| 233 | 1023 | 972 | 95 |
| 178 | 856 | 796 | 93 |
| 761 | 963 | 848 | 88 |
| 932 | 949 | 806 | 85 |
| 722 | 899 | 746 | 83 |
| 275 | 901 | 730 | 81 |
| 567 | 841 | 664 | 79 |
| 902 | 789 | 591 | 75 |

FIG. 8

SYSTEM, METHOD AND IMPLEMENTATION FOR INCREASING A LIKELIHOOD OF IMPROVED HAND HYGIENE IN A DESIRABLY SANITARY ENVIRONMENT

BACKGROUND OF THE INVENTION

This invention relates generally to maintaining hygienic protocols in desirably sanitary environments and more particularly concerns a system, method and implementation for increasing a likelihood of practice of better hand hygiene habits by workers in a desirably sanitary environment such as in a hospital, clinic or medical or dental office or a food preparation, packaging or handling facility or the like.

There is an immediate need for improvement in hand hygiene practices in hospitals, clinics and medical and dental offices and food preparation, packaging and handling businesses. For example, serious nosocomial, hospital-acquired infections affect more than two million patients per year and have been estimated to cause 90,000 patient deaths per year at a cost of treatment approximating $4.5 billion per year in the United States. At the same time, hand washing compliance rates are at an unacceptable 18 to 40 percent and have been reported to be lowest in intensive care units, the highest risk areas of a hospital. Thirty-three percent of hospital acquired infections can be prevented and hand-hygiene is the single most important factor in preventing these infections.

Patients often carry resistant bacteria such as methicillin-resistant *S.aureus* (MRSA) or vancomycin-resistant *enterococci* (VRE) on their skin. Numerous studies show that proper hand hygiene reduces the spread of bacteria in various healthcare settings. Nurses, doctors and other healthcare workers can contaminate their hands by doing simple tasks, including taking a patient's blood pressure or pulse, assisting patients, touching a patient's gown or bed sheets or touching equipment such as bedside rails, over bed tables and IV pumps. The problem is complicated by the circumstance that the sanitary condition of the hands is essentially invisible and undetectable to patients, restaurant workers or other types of workers.

Frequent washing of the hands with plain soap and water or with antimicrobial soap and water has long been recommended. Under new guidelines developed by the Centers for Disease Control and Prevention (CDC) and infection-control organizations, it is now recommended that healthcare workers use an alcohol-based hand rub, whether a gel, rinse or foam, to routinely clean their hands between patient contacts. However, alcohol based rubs are recommended only if the hands are not visibly contaminated with blood or body fluids. More than 20 published studies prove that alcohol-based hand rubs are more effective than soap in reducing the number of bacteria on hands. Therefore, alcohol-based hand-rubs are preferred for routinely cleaning hands before having direct contact with patients, after having direct contact with a patient's skin, after touching equipment or furniture near the patient and after removing gloves. Moreover, several studies also show that nurses who routinely clean their hands between patients by using an alcohol-based hand rub experience the added advantage of less skin irritation and dryness than nurses who wash their hands with soap and water. This advantage is achievable because alcohol-based hand rubs contain skin conditioners or emollients that help prevent the drying effects of alcohol.

Despite the recommendations, there are many relatively obvious and unsophisticated factors which contribute to the prevailing pattern of poor hand washing compliance. Sinks and gel dispensers may be inconveniently located. Hands may already be irritated and dry, discouraging continued washing. Some workers are just "too busy." Some assume or believe that the risk of spreading infection is low. And some simply forget. Some institutions do not emphasize hand hygiene as a priority. Some institutions offer hand hygiene education to their workers but neither sanction the non-compliers nor reward the compliers. In fact, scientific evidence demonstrates that education alone does not change behavioral patterns. Rather, behavioral pattern changes are promoted by operant conditioning in the form of rewards, such as green lights and redemption points, and in the form of sanctions, such as red lights and poor performance reports.

It is, therefore, an object of this invention to provide a system, method and implementation to promote the benefits of improved hand hygiene. Another object of this invention is to provide a system, method and implementation to increase the likelihood of practice of better hand hygiene habits by workers in a desirably sanitary environment. Still another object of this invention is to provide a system, method and implementation which make hand hygiene products more available and convenient to workers in a desirably sanitary environment. An additional object of this invention is to provide a system, method and implementation which are capable of reminding workers of the need to use the hand hygiene system. Yet another object of this invention is to provide a system, method and implementation which are capable of monitoring workers' hand hygiene activities. A further object of this invention is to provide a system, method and implementation which are useful in encouraging both workers and others present in the vicinity of a desirably sanitary environment to consistently practice proper hand hygiene protocol. It is also an object of this invention to provide a system, method and implementation which are able to provide feedback useful in improving habits fostering hand hygiene. Another object of this invention is to provide a system, method and implementation which provide a basis for implementing a strategy of rewards and sanctions which will encourage the practice of better hand hygiene.

SUMMARY OF THE INVENTION

A desirably sanitary environment may include multiple areas in which appropriate hand hygiene is to be maintained. In a hospital, for example, any number of separate patient, laboratory and treatment rooms may be located throughout an environment that is to be hygienically clean. Such an environment will likely also have a number of hand hygiene stations dispersed throughout, some in the rooms, some in hallways or common areas outside the rooms and some in separate rooms such as staff bathrooms and the like. Workers are continuously entering and exiting all of these rooms and areas and should be complying with proper hand hygiene protocols as they move from contact with one patient to another. Consequently, in accordance with the invention, a system, method and implementation are provided for increasing the likelihood of hand hygiene in a desirably sanitary environment.

The system includes use of credentials employing infrared, radio frequency, bar code, magnetic strip card, proximity sensor, wiegand, bar-code, induction circuit, capacitance circuit or similar technology, with or without another form of recognition such as biometric sensors, to identify each worker. In implementation, each worker who is anticipated to have access to the desirably sanitary area is provided with a credential unique to that worker. In effectuating the method, the worker wears or otherwise transports the credential, perhaps in the form of a badge, while on the job. Preferably, the credential will include video and audio indicators, such as red, yellow and green lights and a beeper. The visual and audio indicators on the credentials, in conjunction with timing circuits in the network, serve as reminders of compliance or non-compliance with predetermined hand hygiene protocols determined by the system user.

The system also includes sensors that detect and respond to the presence of the credentials. In implementation, the sensors are located to monitor the various access passages of the protected rooms of the desirably sanitary environment. In effectuating the method, on entry and exit of a credential to and from a protected room of the desirably sanitary environment, the detecting sensors cause a corresponding signal to be emitted to the network processor so as to enable registration of the "entry" and "exit" events.

The system further includes a wired or wireless network which, in implementation, is connected to electronic dispensers such as alcohol rub dispensers and soap or soap and water dispensers located at the hand hygiene stations of the desirably sanitary environment. Each dispenser has a credential detecting proximity reader. In effectuating the method, in response to a proximity reader demand, the station dispenses the correct amount of rub solution or soap and water and emits a signal to the processor so as to enable recording of the event.

The system network processor receives the input signals from the various sensors and dispensers and processes them so as to monitor and record compliance with the protocols established for the system and to produce reports with respect to worker compliance. For hand hygiene stations located outside of the desirably sanitary environment, an appropriate protocol would be to sequentially sanitize the hands, enter the area within a predetermined time after sanitizing, exit the area and again sanitize the hands within a predetermined time after exiting. For hand hygiene stations located inside of the desirably sanitary environment, an appropriate protocol would be to sequentially enter the area, sanitize the hands within a predetermined time after entry, again sanitize the hands and exit the area within a predetermined time after the second sanitization. Depending on the application and the associated floor plan, other protocols may be established. In implementation, the processor will be programmed to acknowledge each completion of either or both the described protocols or such other protocols as may be established. For example, the system is preferably further programmable so as to permit changes in the protocol cycle depending on local definition or new medical evidence and recommendations. In effectuating the method, upon a completion of a protocol cycle, the processor will acknowledge successful completion of the cycle by counting the completed cycle to the credit of the associated credential and/or causing activation of visual confirmation, such as the green light associated with the credential, as a notice of compliance with a selected portion of the protocol. If the processor is unable to determine compliance with protocol, for example if an improper sequence of event identifying signals is received by the processor or an inordinate time delay occurs between events, the processor may cause activation of the yellow or red light and/or the beeper on the credential to alert the worker and others in the area of the non-compliance with protocol. If the red light is activated, the worker can reset the credential to a green light condition by performing an appropriate hand-hygiene activity at any of the hand hygiene stations while the credential is detected by a sensor at that station. Preferably, if a protocol cycle is initiated but not completed, the processor will either acknowledge the failure to complete the cycle by counting the incomplete cycle as a debit with respect to the associated credential or, in the alternative, simply not permit any portion of an incomplete cycle to contribute as a credit with respect to the associated credential.

It is desirable, in implementing the system, that sensors be located to monitor all staff bathroom doorways and sinks as part of the network to more completely account for bathroom related hand sanitizing compliance. It is also desirable, in implementing the system, that workers receive a monthly print-out of their hand hygiene performance record as well as a cumulative statement of their monthly credits and debits, perhaps with a comparative ranking to enable them to personally evaluate their own performance in relation to the performance of a group of workers taken as a whole. As a further incentive, workers may be given the opportunity to receive more tangible benefits from good hand hygiene performance by the redemption of their accumulated credits, such as by credit toward purchases in a cafeteria, gift shop, coffee shop or from a rewards catalog. Such reward programs may be implemented on group and/or individual bases.

BRIEF DESCRIPTION OF THE DRAWINGS

Other objects and advantages of the invention will become apparent upon reading the following detailed description and upon reference to the drawings in which:

FIG. 8 is an embodiment of a report of hand hygiene data generated by the hand hygiene system.

While the invention will be described in connection with preferred embodiments, methods and implementations thereof, it will be understood that it is not intended to limit the invention to those embodiments, methods or implementations or to the details of the construction or arrangement of parts or steps illustrated in the accompanying drawings.

DETAILED DESCRIPTION

Figure 1:
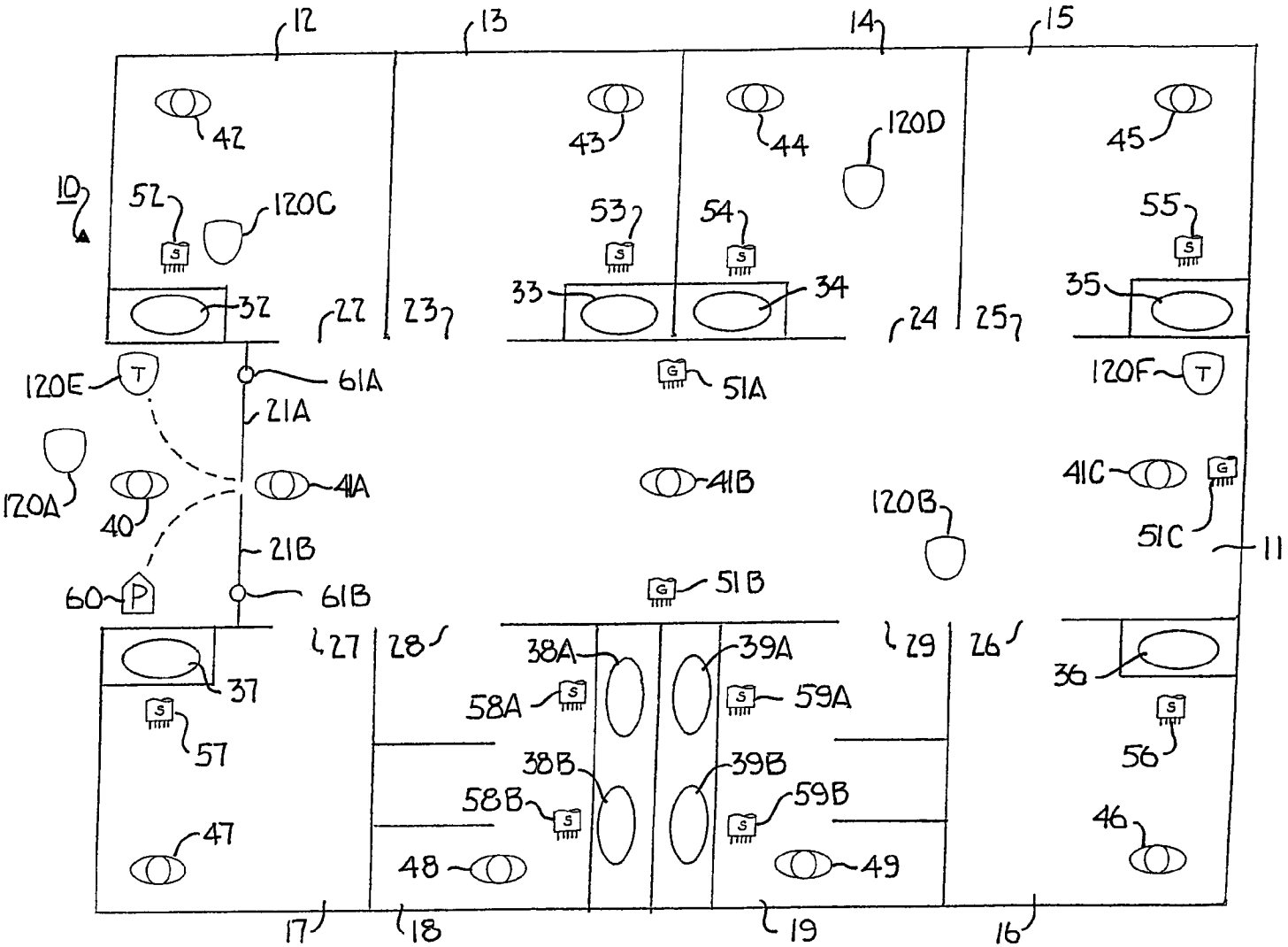
FIG. 1 is a sample floor plan of a desirably sanitary environment with embodiments of the worker tracking and hygienic substance dispensing systems of the hand hygiene system superimposed thereon.

Turning first to FIG. 1, an exemplary floor plan of a desirably sanitary environment 10 is provided for the purpose of describing the invention. More particularly, FIG. 1 illustrates a skeletal layout of at least a portion of a hospital care area. While the invention is described in relation to this illustrated environment 10, the embodiments, methods and procedures of the invention are applicable to any environment which is targeted for improvement in hand hygiene practice.

The illustrated environment 10 is divided into areas including a hallway 11, patient rooms 12-17 and lavatories 18 and 19. Each of the areas 11-19 has doors or accesses 21-29. Some of the rooms 12-19 have one or more sinks 32-39. Assuming that a worker may come in contact with a patient in any of the patient rooms 12-17, it is desirable to assure that the worker has implemented suitable hand-hygiene protocol before and after contacts with each patient with as great a degree of diligence as possible. While the protocol may differ according to the nature of the environment and even according to the special standards of a particular environment, the principles are the same. To this end, in this exemplary case, sensors 40-49 are located throughout the environment 10 to monitor the locations of the workers in the environment 10 on a continuous real time basis. To facilitate the practice of suitable hand hygiene activities, each of the sinks 32-39, and the hallway 11 in which no sink is available, are provided with gel or soap dispensers 51-59. For convenience in following the description, the associated elements of each area 11-19 are assigned identifying numbers with common digits. For example, a room access 22, a sink 32, a sensor 42 and a soap dispenser 52 are all associated with one room 12. Similarly, another room 13 has an associated room access 23, a sink 33, a sensor 43 and a soap dispenser 53. The identifying numbers of elements associated with the remaining areas and rooms are similarly coordinated for convenience of description. In areas having more than one element, the common elements are alphabetically grouped. For example, the lavatory 18 has two sinks 38A and 38B. The main doors 21A and 21B accessing the interior of the environment 10 are operable by a proximity reader 60 and power door operators 61A and 61B.

Figure 2:
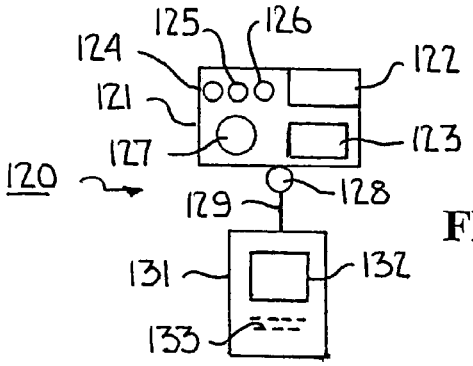
FIG. 2 is a front view of an embodiment of a credential to be transported with the worker for interaction with the tracking and dispensing systems of FIG. 1.

As seen in FIG. 1, the system tracks workers by tracking permanently issued credentials 120A-D or temporary credentials 120E-F which are made available to workers who do not have or have forgotten to carry their permanently issued credential and are, in real time, approved to access the desirably sanitary environment 10. Looking at FIG. 2, an embodiment of a typical credential 120 is shown in greater detail. The credential 120 includes a case 121 with an infrared (IR) transmitter 122 and a transceiver 123. The credential 120 has green, yellow and red LED's 124, 125 and 126, and a beeper/speaker 127. A clip (not shown) may be provided on the back of the case 121 to facilitate attachment of the credential 120 at a visible location on the apparel of the worker. A "zinger" 128 mounted on the bottom of the badge 120 permits retraction and extension of a cord 129 which is connected to a magnetic stripe, proximity and/or embedded chip card 131. The card 131 may display photo identification 132 and/or printed identification 133 of the worker to whom it is assigned. Any or all of the permanent 120A-D and temporary 120E-F credentials shown in FIG. 1 may have the same embodiment as the typical credential 120 illustrated in FIG. 2, but other embodiments of the credentials may be configured according to the needs of a particular application or environment. The credentials may, as shown, be structurally unitary or may employ structurally discrete components. For example, an IR system presently available from Versus Technology tracks workers by the use of IR badges which emit their own unique IR signal every three seconds for detection by IR sensors mounted on the ceilings of the areas selected for monitoring. BCM4317 single-chip wireless transceivers by Broadcom and associated transceiver/indicator/alert badges may be used in conjunction with the Versus Technology IR badges. Green and red LEDs on the badges can be used to indicate the state of hand-hygiene of the worker as being "hands clean" or "hands dirty," respectively. Additional "please sanitize" visual indicators, such as yellow LEDs, may also be incorporated on each of the badges to remind the workers in the event of a failure to initiate dispensation of the hand-hygiene substance within a predetermined time after entering or exiting a monitored area. Similarly, audible alerts can be incorporated on each of the badges to provide unique sounding alarms corresponding to the red and yellow "hands dirty" and "please sanitize" visual indicators.

Figure 3:
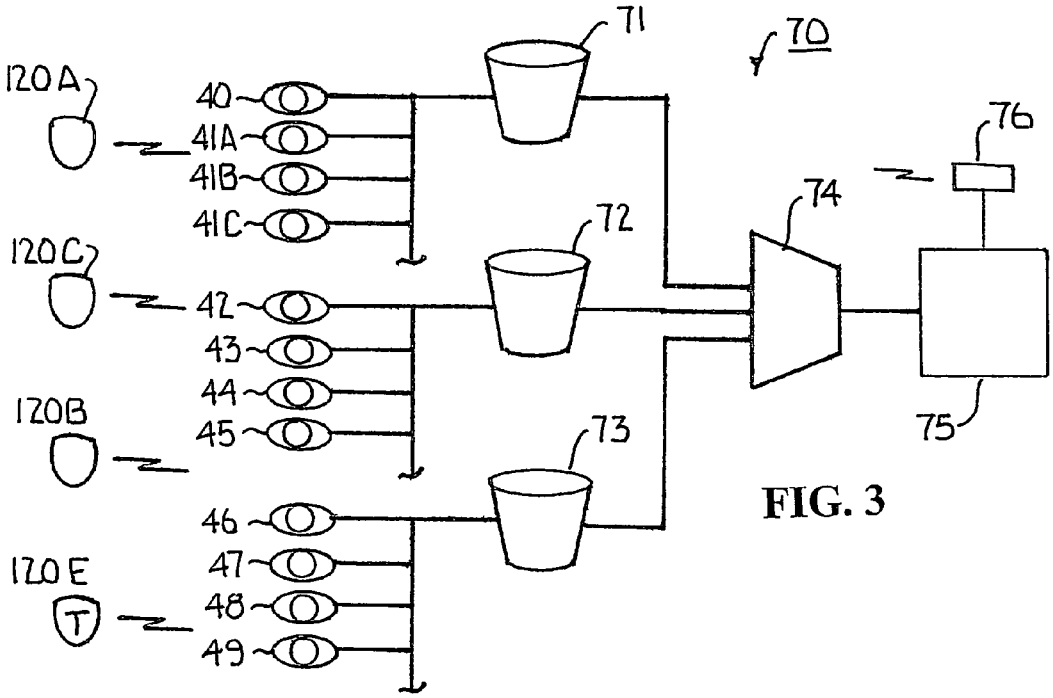
FIG. 3 is a schematic diagram of the tracking system of FIG. 1.

Looking at FIG. 3, the worker tracking system 70 associated with the environment 10 of FIG. 1 includes the credentials 120 and sensors 40-49 above discussed. In addition, the system 70 includes collectors 71-73, a concentrator 74, a processor 75 and a transmitter 76 which receive and process data so as to continuously monitor the real-time location of each worker transporting a credential 120. Each collector 71-73 can receive credential data signals from as many as 24 associated IR sensors 40-49 and assemble them into network ready packets. The collectors 71-73 relay them to a concentrator 74 which serves as the interface between the collectors 71-73 and the network processor 75. A transmitter 76 communicates with the transceivers 123 of the credentials 120 under the control of the processor 75 to activate the green, yellow and red LED's 124, 125 and 126 and the beeper/speaker 127 on the appropriate credential 120 in accordance with the protocol established by the processor 75.

Figure 4:
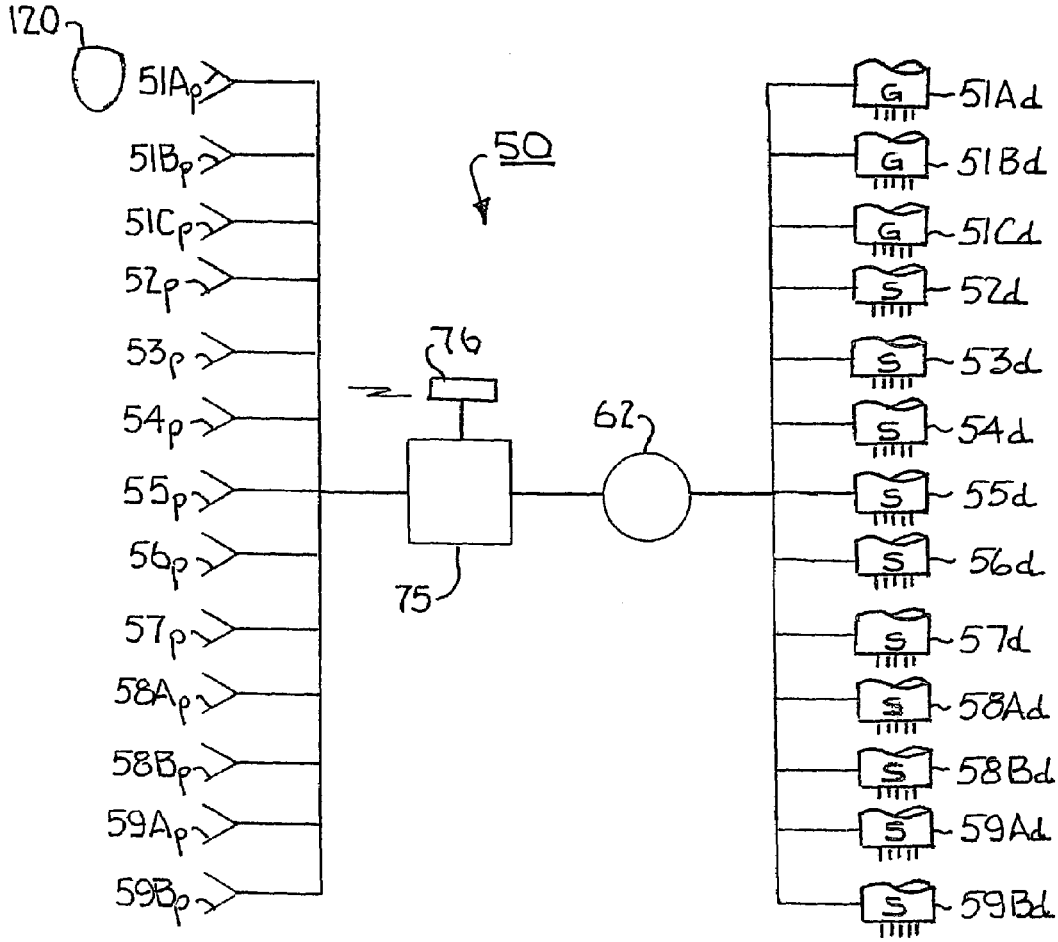
FIG. 4 is a schematic diagram of the dispensing system of FIG. 1.

Turning now to FIG. 4, the hand-hygiene station substance dispensing system 50 may include any one or more of various types of soap, soap and water or alcohol based gel, rinse or foam dispensers, such as Sloan Optima Electronic Soap Dispensers or Savona Auto Electronic Dispensers or the like. Each dispenser 51*d*-59*d* has an associated proximity reader 51*p*-59*p* which detects the workers' unique credentials. For example, card readers such as HID Proximity Readers or Magtek 21080203 Card Readers or other devices may be used. Each dispenser 51*d*-59*d* is connected via a controller 62 to the network processor 75. Each proximity reader 51*p*-59*p* is also connected to the network processor 75. Detection of a credential 120 by a proximity reader 51*p*-59*p* signals the processor 75 to activate the controller 62 to cause its associated dispenser 51*d*-59*d* to release a predetermined quantity of soap, soap and water, gel, foam or rinse and to send a signal indicative of completion of such release to the network processor 75. The network processor 75 then records the event and causes a wireless signal to be emitted by the transmitter 76 to the transceiver 123 of the corresponding credential 120 to energize its green "hands clean" LED 124.

Figure 5:
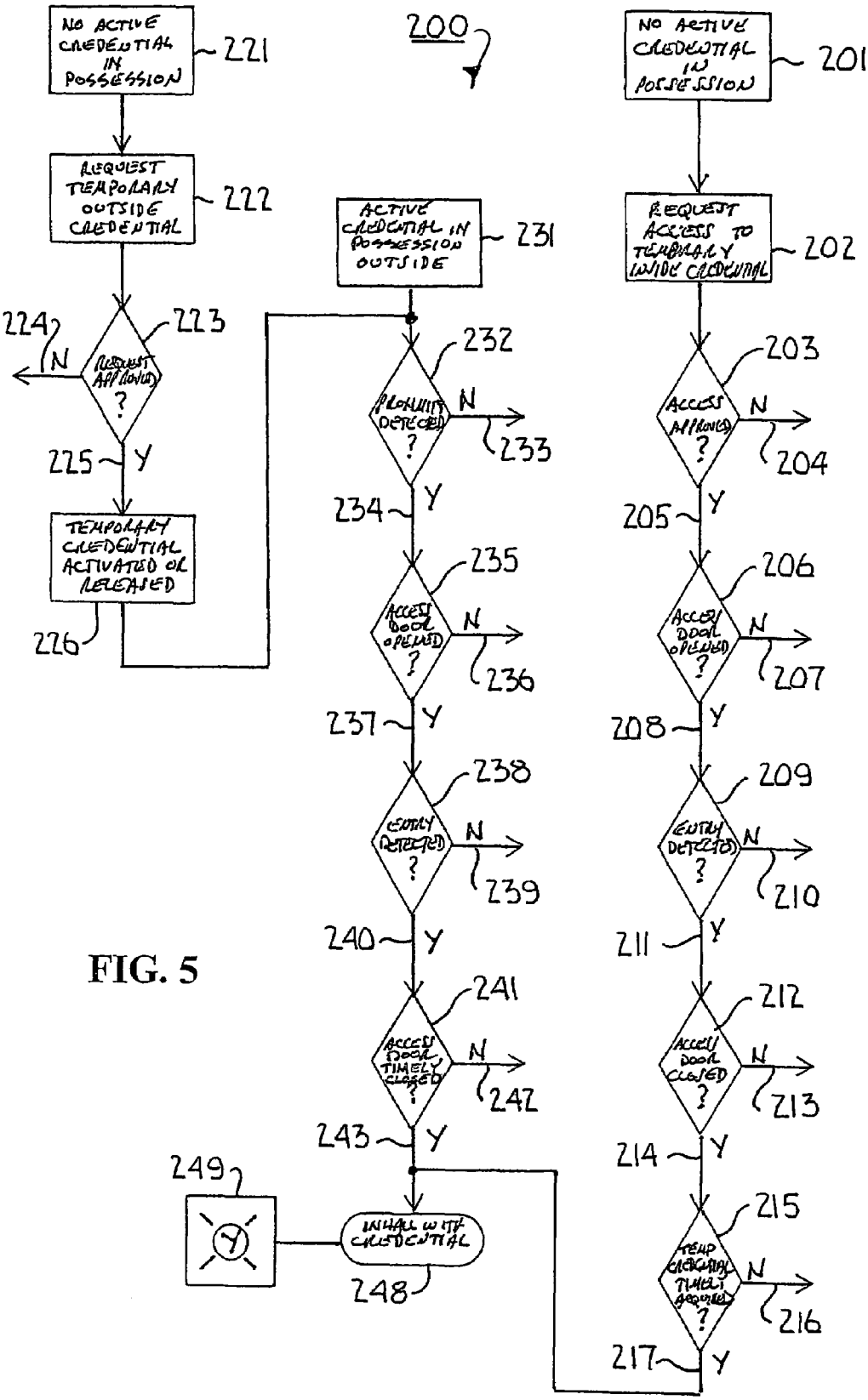
FIG. 5 is a flow diagram of an embodiment of the credential-approval routine of the hand hygiene system.
Figure 6:
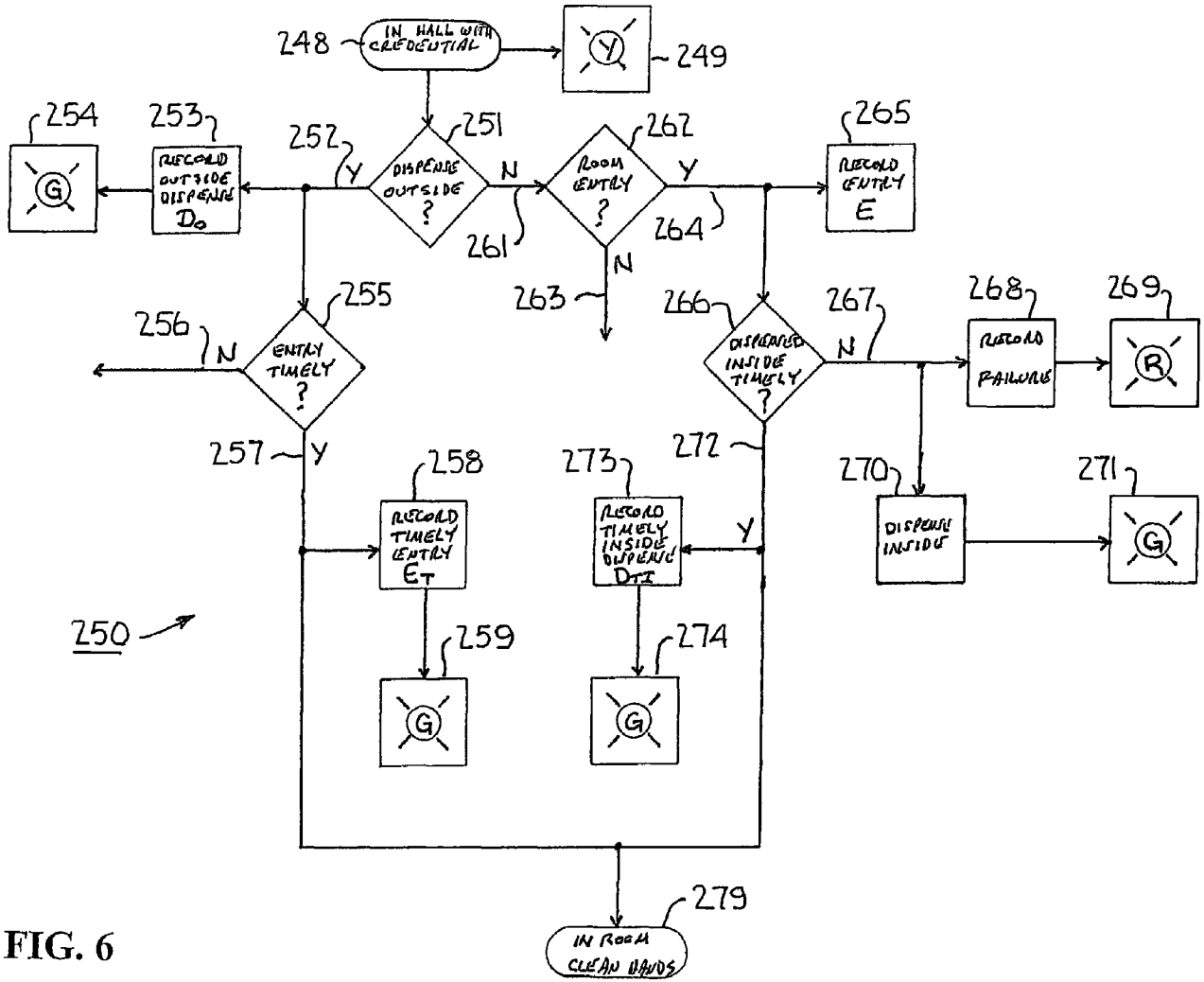
FIG. 6 is a flow diagram of an embodiment of the credential-entry-options routine of the hand hygiene system.
Figure 7:
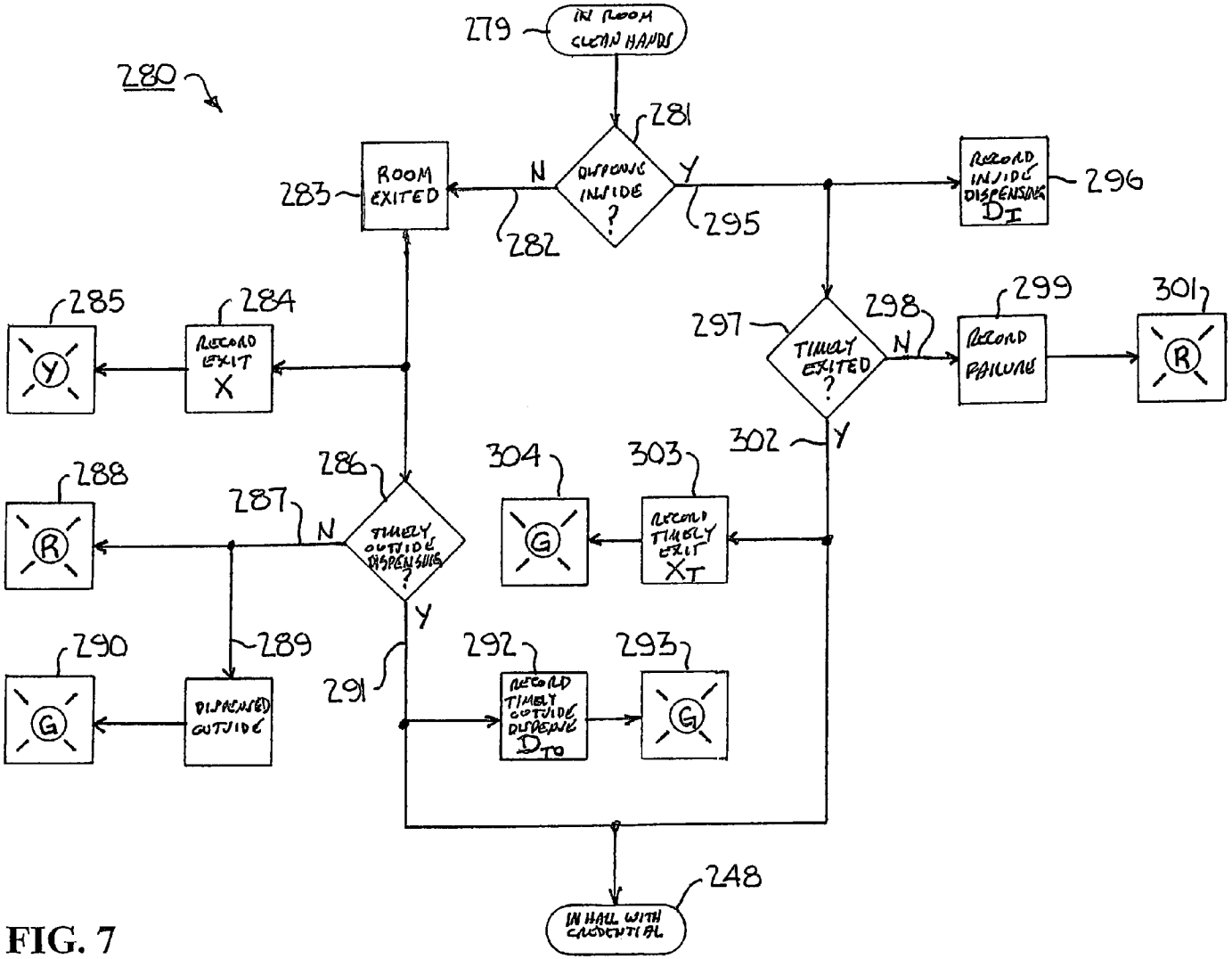
FIG. 7 is a flow diagram of an embodiment of the credential-exit-options routine of the hand hygiene system.

The network processor 75 is preferably programmed to accept some protocol cycles of hand-hygiene behavior and to reject all others. If an acceptable protocol cycle of hand-hygiene is completed, the processor 75 will cause the event to be recorded as a positive cycle for the worker. If an acceptable protocol cycle of hand-hygiene is required but not completed within a predetermined time period, the processor 75 will cause the failure to be recorded as a negative event for the worker. As above noted, the protocols may vary from application to application. In FIGS. 5, 6 and 7, the operation of the improved hand hygiene system is illustrated in relation to preferred embodiments of the environment access, patient room entry and patient room exit procedures 200, 250 and 280, respectively, carried out by the network processor 75 and associated programming for a typical protocol.

Looking at FIG. 5, the environment access procedures 200 are based on the protocols pursuant to which a worker will be entitled to gain access to the desirably sanitary environment 10. The environment access procedure 200 may apply to one or more of three possible options or scenarios. If a worker has no active credential 120 in possession at the time access to the environment 10 is desired, in the first scenario 201, a temporary credential 120F will be available within the confines of the environment 10 and in the second scenario 221, a temporary credential 120E will be available outside of the environment 10. In the third scenario 231, the worker will have an assigned active credential 120 in possession at the time access is desired.

It is presumed that, in an application in which one or both of the first and second scenarios 201 and 221 may occur, the access doors 21A and 21B to the environment 10 will be monitored so as to enable verification of the identity of the worker prior to entry. It is also presumed that some means of communication exists between the point of entry to the environment 10 and the location at which security personnel monitoring access to the environment 10 are present. Such communication should include means for the worker to signal a desire to gain access and for the security personnel to either activate an accessible temporary credential or release a temporary credential which has already been activated and/or to operate the entry doors 21A and 21B. It is preferred that the communication means be in communication with the network processor 75 so as to notify the system of a request for a temporary credential. It is also preferred that the communication means be in communication with the network processor 75 so as to notify the system of the approval by the security personnel of the request. It is further preferred that the communication means, in executing the release or activation of the temporary card, also be in communication with the network processor 75 to confirm that a temporary credential has been activated or released.

In the first scenario with "no active credential in possession" 201 and with a temporary credential 120F available inside the confines of the environment 10, the worker will use the communication system with the security personnel to request access to the temporary inside credential 120F. Preferably, this request will automatically signal to the system "request for access to temporary inside credential" 202. The system will then inquire as to whether "access approved" 203 by the security personnel. If the answer to the inquiry "access approved" 203 is "NO" 204, the system will return to the status "no active credential in possession" 201 until another "request access" 202 is made. If the reply to the inquiry "access approved" 203 is "YES" 205, the system will proceed to inquire as to whether the "access door opened" 206. The answer to the inquiry "access door opened" 206 can be determined, for example, by electronically monitoring the status of the power door operators 61A and 61B or the doors 21A and 21B. If the answer to the inquiry "access door opened" 206 is "NO" 207, the system will return to the status "no active credential in possession" 201. If the reply to the inquiry "access door open" 206 is "YES" 208, the system will inquire as to whether "entry detected" 209. If the reply to the inquiry "entry detected" 209 is "NO" 210, the system will return to the status "no active credential in possession" 201. If the reply to the inquiry "entry detected" 209 is "YES" 211, the system will next inquire as to whether "access door closed" 212. If the reply to the inquiry "access door closed" 212 is "NO" 213, the system will preferably cause an indication of this condition to be communicated to the security personnel. If the reply to the inquiry "access door closed" 212 is "YES" 214, the system will next inquire as to whether "temporary credential timely acquired" 215. If the reply to the inquiry "temporary credential timely acquired" 215 is "NO" 216, the system will preferably advise security personnel of this condition. If the reply to the inquiry "temporary credential timely acquired" 215 is "YES" 217, the system will proceed to the status "in hall with credential" 248 indicative of the presence of a worker in the environment 10 with an active credential 120 and the yellow LED 125 will be activated 249 to the "please sanitize" status.

In the second scenario with "no active credential or possession" 221 and with a temporary credential 120E available outside of the environment 10, the operation of the communication system to request access from the security personnel will automatically signal to the system a "request temporary outside credential" 222. The system will then inquire as to whether "request approved" 223. If the answer to this inquiry is "NO" 224, the system will return to the status "no active credential in possession" 221 and wait for such a request. If the reply to the inquiry "request approved" 223 is "YES" 225, the security personnel will then activate or release the temporary credential 120E and the action taken by the security personnel will preferably automatically cause a signal to the system of the status "temporary credential activated or released" 226. Once the temporary credential 120E is activated and/or released to the possession of the worker, the procedure of the second scenario 221 will continue as in the third scenario 231 hereinafter described.

In the third scenario with an "active credential in possession outside" 231, the worker outside of the environment 10 may have either an active credential 120A which was issued to them or a temporary credential 120E acquired outside of the environment 10 pursuant to the second scenario 221. In either event, the system constantly inquires as to whether "proximity detected" 232 for any credential. If the answer to the inquiry "proximity detected" 232 is "NO" 233, the system returns to the status "no active credential in possession" 231. If the answer to the inquiry "proximity detected" 232 is "YES" 234, the system will next inquire as to whether the "access door opened" 235. If the answer to the inquiry "access door opened" 235 is "NO" 236, the system will preferably notify the security personnel of this status. If the answer to the inquiry "access door opened" 235 is "YES" 237, the system will inquire as to whether "entry detected" 238. If the reply to the inquiry "entry detected" 238 is "NO" 239, the system will preferably cause the access door to close and notify the security personnel of this status. If the reply to the inquiry "entry detected" 238 is "YES" 240, the system will inquire as to whether the "access door timely closed" 241. If the answer to the inquiry "access door timely closed" 241 is "NO" 242, the system will preferably cause the door to close and notify security personnel. If the reply to the inquiry "access door timely closed" 241 is "YES" 243, the system proceeds to the status "in hall with credential" 248 and the yellow LED 125 will be activated 240 to the "please sanitize" status.

Turning to FIG. 6, the end result of each of the environment access procedures 200 for any of the scenarios 201, 221, or 231 is to achieve the status "in hall with credential" 248 indicative of the presence of a worker in the environment 10 with an active credential 120. When the status "in hall with credential" 248 is achieved, the system will activate the yellow LED 125 on the credential 120 so that the worker and those in contact with the worker will know that the worker is present in the environment 10 and has not yet properly completed a hand-hygiene protocol.

The system now monitors the worker's activities in accordance with the protocols determined by the user for that particular application. In FIG. 6, one embodiment of the protocol for "patient room entry" 250 is illustrated. Once the worker is in the environment 10 and the yellow LED 125 is activated 249 to the "please sanitize" status, the system continually inquires as to whether an event "dispense outside" 251 has occurred. Such an event is signaled when an outside dispenser detects the proximity of a credential 120. In this regard, looking at FIGS. 1 and 4, rooms 12-17 are rooms in which a worker may come in contact with a patient. Soap dispensers 52-57 are located in these rooms, respectively. All other dispensers, including the gel dispensers 51A, 51B and 51C in the hall 11 and the soap dispensers 58A, 58B, 59A and 59B in the lavatories 18 and 19 are outside dispensers.

If any proximity reader 51*p*-59*p* of an outside dispenser 51A-C, 58A-B or 59A-B detects the proximity of the credential 120, the reply to the inquiry "dispense outside" 251 is "YES" 252 and the system will automatically cause the associated dispenser to dispense its hand hygiene substance and "record outside dispense $D_O$" 253. The green LED" 124 is activated 254 to the "hands clean" status. The effectiveness of the system assumes that a worker who has presented a credential to a proximity reader 51*p*-59*p* as illustrated in FIG. 4 will receive and use the hand hygiene substance dispensed by the same dispenser 51-59. After dispensing substance outside, the system inquires as to whether there has been "timely entry" 255 into a patient's room. The duration of the specified time will be established by the system user in accordance with the user's protocol needs. If the worker has not entered a patient's room within the specified time, the reply to the inquiry "entry timely" 255 will be "NO" 256, in which case the system will return to the status "in hall with credential" 248. The yellow LED 125 is activated 249 to the "please sanitize" status. However, if the response to the inquiry "entry timely" 255 is "YES" 257, the system will "record timely entry $E_T$" 258 and the green LED 124 is activated 259 to the "hands clean" status. The system will then proceed to the status "in room-clean hands" 279.

If none of the outside dispensers 51A-C, 58A-B or 59A-B detects the proximity of a credential 120, the response to the inquiry "dispense outside" 251 is "NO" 261 and the system continuously waits to detect a "room entry" 262. If no active credential 120 is detected to have made a "room entry" 262, the answer to the inquiry "room entry" 262 is "NO" 263 and the system returns to the status "in hall with credential" 248 with the yellow LED 125 activated 249 to the "please sanitize" status. If an active credential 120 enters into any patient room 12-17, the answer to the inquiry "room entry" 262 is "YES" 264 and the system will "record entry E" 265. In this event, the system will next inquire as to whether the appropriate inside dispenser, that is the dispenser in the entered room, has "dispensed inside timely" 266 which occurs if the proximity reader 51*p*-59*p* at the dispenser 51*d*-59*d* detects the timely proximity of the credential 120. If the response to the inquiry "dispensed timely inside" 266 is "NO" 267, the system will preferably "record failure" 268 and the red LED 126 will be activated 269 to the "hands dirty" status. Preferably, simultaneously, the beeper 127 will be activated to provide an audible indication of the "hands dirty" status. In this status, any event in which the credential 120 associated with the "hands dirty" status triggers the in room dispenser to "dispense inside" 270, the green LED 124 will be activated 271 to the "hands clean" status and, if applicable, the beeper 127 deactivated. Again, the time within which the inside dispenser must detect the proximity of the credential 120 will be established by the user of the system in accordance with its particular protocol needs. If the response to the inquiry "dispensed inside timely" 266 is "YES" 272, then the system will "record timely inside dispense $D_{TI}$" 273. The green LED 124 is activated 274 to indicate the "hands clean" status and, if applicable, the beeper 127 is deactivated. The system now proceeds to the status "in room-clean hands" 279.

Upon completion of the "patient room entry" 250 procedure, a worker will have completed the first half of an acceptable hand hygiene protocol either by a demand on outside proximity reader 51*p*, 58*p* or 59*p* for an "outside dispensing $D_O$" of substance followed by a "timely entry $E_T$" into a patient's room 12-17 or by an "entry E" into a patient's room 12-17 followed by a demand on an inside proximity reader 52*p*-57*p* for a "timely inside dispensing $D_{TI}$" of hand hygiene substance.

The "patient room exit procedures" 280 constituting the second half of an acceptable hand hygiene protocol are illustrated in FIG. 7. Once the worker has achieved the status "in room-clean hands" 279, the green LED 124 on the credential 120 has been activated to evidence compliance with the first half of the protocol. The presence of the worker in the patient's room means that there has possibly been contact with the patient. The system, therefore, will continuously inquire as to whether another demand has been made for a sanitizing substance before the worker leaves the patient's room. It is assumed that such a demand will result in substance being dispensed to the worker making the demand.

If the response to the inquiry "dispensed inside" 281 is "NO" 282 and the system detects "room exited" 283, the system will "record exit X" 284 and the yellow LED 125 is activated 285 to the "please sanitize" status. The system will then inquire as to whether a demand is made for a "timely outside dispensing" 286 of sanitizing substance, which is assumed if a proximity reader 51*p*, 58*p* or 59*p* of an outside dispenser 51*d*, 58*d* or 59*d* timely detects the proximity of a credential 120. The permissible time delay between "room exited" 283 and "timely outside dispensing" 286 is established by the user in accordance with the user's particular protocol needs. If the response to the inquiry "timely outside dispensing" 286 is "NO" 287, the red LED 126 will be activated 288 to evidence the "hands dirty" status and, if desired, the beeper 127 will also be activated to give audio alert to the status. In this status, the worker can make a demand for substance to be "dispensed outside" 289 to cause the green LED 124 to be activated to the "clean hands" status. If the answer to the inquiry "timely outside dispensing" 286 is "YES" 291, the system will record "timely outside dispensing $D_{TO}$" 292 and the green LED" 124 will be activated 293 as visual indication of a "hands clean" status. The completion of the room exited X and timely outside dispensing $D_{TO}$ protocol after completion of either of the acceptable room entry protocols discussed above results in a credit to the credential 120. The green LED 124 will indicate the "hands clean" status for a predetermined time period and then will return the worker to the status "in hall with credential" 248 of FIG. 6 with the yellow LED 125 indicating the "please sanitize" status.

If the response to the inquiry "dispensed inside" 281 is "YES" 295, the system will "record inside dispensing $D_I$" 296. The system will then inquire as to whether the worker has "timely exited" 297 the room. The duration of time between "dispensed inside" 295 and "timely exited" 297 is also determined by the user in accordance with the user's hand hygiene protocol needs. If the answer to the inquiry "timely exited" 297 is "NO" 298, the system will "record failure" 299 and the red LED 126 is activated 301 to evidence the "hands dirty" status. If applicable, the beeper" 127 will also be activated to provide audio alert of the "hands dirty" status. If the answer to the inquiry "timely exited" 297 is "YES" 302, the system will "record timely exit $X_T$" 303 and the green LED 124 is activated 304 to evidence the "hands clean" status. The completion of the dispensed inside $D_I$ and timely exited $X_T$ protocol after completion of either of the acceptable room entry protocols results in a credit to the credential 120. The green LED 124 will indicate the "hands clean" status for a predetermined time period and then will return the worker to the status "in hall with credential" 248 of FIG. 6 with the yellow LED 125 indicating the "please sanitize" status.

Thus, with respect to a single credential 120, when any of the four possible correct protocols occurs, a credit will be applied to the account of that credential 120. To summarize, the four acceptable protocols are:

$D_O+E_T+X+D_{TO}$;

$D_O+E_T+D_I+X_T$;

$E+D_{TI}+X+D_{TO}$; and $E+D_{TI}+D_I+X_T$.

Returning to FIG. 1, the operation of the system in monitoring a worker, encouraging compliance with protocol and recording data useful in analyzing worker reports can be understood. If, for example, a worker does not have their personal credential 120 in their possession and desires access to the environment 10 to interact with a patient in the room 15 at the far left end of the hallway 11, the worker would go to the location outside the entry doors 21A and 21B where temporary credentials such as the credential 120E are available. At that location, using the available means of communication with security personnel, the worker would request issuance of the temporary card 120E. That request is preferably automatically entered into the system. The security personnel would confirm that the worker was approved by the system user for access to the environment 10 and, if so, use the communication system either to activate the credential 120E for the worker or, if the credential 120E was already activated, to release the activated credential 120E to the worker. Preferably, upon the taking by the worker of the activated or released credential 120E, the communication system would automatically enter confirmation into the system of the activation or release of the temporary credential 120E. Such confirmation would enable the system to determine the frequency of such requests as well as positive responses to such requests. Once the temporary credential 120E has been activated or released, the temporary credential 120E can be handled in one of two ways depending on the preference of the system user. If the user's goal is to encourage the use of permanent credentials 120, the system can be configured so that the temporary credential 120E will be monitored by the system to encourage compliance with hand hygiene protocol but will not be credited to the worker's credits for compliance. If, however, the user's goal was strictly to encourage hand hygiene protocol compliance, the use of the temporary credential 120E could be credited to the worker until the credential 120E is returned to its source.

Assuming a system in which credit is to be given, the system will operate in the same fashion for a temporary card 120E as it would for a permanent card 120A used to gain admittance through the doors 21A and 21B to the environment 10. The worker would present the active card 120 to the proximity reader 60 and the access doors 21A and 21B would open. The sensor 40 outside of the doors 21A and 21B would monitor the presence of the worker outside of the doors and, upon the worker's entry into the hallway 11, monitoring of the worker's presence would transfer to the first sensor 41A in the hallway 11. When the first sensor 41A detects the worker's presence, the access doors 21A and 21B would close. The closing should occur within a short period of time after the opening to assure that only the approved worker in possession of the credential 120 has entered the hallway 11. If the access door has not closed within a short enough time interval after entry of the worker, security personnel should be alerted as to the delay. If the initial sensor 41A has detected entry and the doors 21A and 21B have timely closed, the system will preferably record that the credential 120 is now in the environment 10 and activate the yellow LED 125 on the credential to indicate that, at this point, the worker is in a "please sanitize" status. As the worker moves down the hallway 11, the monitoring task will switch from the initial sensor 41A to the intermediate sensor 41B in the middle of the hallway 11. As the worker continues down the hallway 11, the monitoring responsibility will eventually transfer from the intermediate sensor 41B to the end of hall sensor 41C. During this time the yellow LED 125 continues to indicate the "please sanitize" status. When the worker enters the patient room 15 through entry 25, monitoring responsibility transfers to the in-room sensor 45. The detection of the entry into the room 15 by the sensor 45 causes the system to record the entry E as a protocol event. Since no sanitizing activity has previously been attributed to this credential, the detection of the room entry will activate a system timer to assure that a sanitizing event occurs in the room quickly enough that there is little likelihood that the worker can come in contact with the patient prior to the sanitizing action. If the proximity reader of the in-room soap dispenser 55 does not detect the proximity of the credential 120 within the specified time, the red LED 126 on the credential 120 will be activated to indicate the "hands dirty" status. Preferably, the audio or beeper 127 of the credential 120 will also be activated, so that both visual and audio alarms as to the "dirty hands" condition is given. On the other hand, if the proximity of the credential 120 is timely detected by the dispenser 55, then the timely dispensing of the substance by the inside dispenser $D_{TI}$ will be assumed and recorded by the system as a protocol event. The green LED 124 will be activated and the beeper 127 deactivated so as to indicate the "hands clean" status for the credential 120.

If, on the other hand, the worker used one of the outside dispensers 51A, 51B or 51C in the hallway 11 or one of the outside dispensers 58A, 58B, 59A or 59B in a lavatory 18 or 19, then the detection by the outside dispenser of the proximity of the credential 120 would cause the system to assume the dispensing of substance for use by the worker and to record an outside dispensing $D_O$ as a protocol event. Such a dispensing would also result in the activation of the green LED 124 so as to indicate the "hands clean" status. To assure that the hands do not become contaminated after the sanitizing event, the worker must enter the patient's room 15 in timely fashion thereafter. If the room sensor 45 does not detect an entry within the specified time, then the system reverts to the in-hall status, records the failure and activates the yellow LED 125 to advise of the "please sanitize" status.

However, if the sensor 45 in the room 15 detects the entry of the credential 120 within the time specified, the timely entry $E_T$ is recorded as a protocol event.

Consequently, whether the worker entered the patient's room E and timely executed a sanitizing event in the room $D_{TI}$ or performed a sanitizing event out of the room $D_O$ and then timely entered the room $E_T$, half of a satisfactory protocol cycle would have been recorded and the green LED 124 will indicate the "hands clean" status. If these events were not timely completed and the worker was in the patient's room 15, then the red LED 126 and beeper 127 would notify of the "dirty hands" status.

When the worker finishes the tasks to be performed in the patient's room 15, the worker's hands are likely contaminated as a result of contact in the room 15. If, before exiting the room 15 the worker uses the dispenser 55, then the system will record the inside dispensing $D_I$ as a protocol event. If the worker exits the room 15 in timely fashion after the sanitizing event, the system will also record the timely exit $X_T$ as a protocol event. If the worker does not exit the room 15 in time, the red LED 126 will be activated and the beeper 127 will sound to indicate the "hands dirty" status. If the worker exits the room 15 before sanitizing the system will record the exit X as a protocol event. If the worker timely sanitizes after exiting the room 15, the system will record the timely outside dispensing $D_{TO}$ as a protocol event. If the worker does not timely sanitize after exiting, then the red LED 126 will be activated and the beeper 127 will sound to indicate the "hands dirty" status. Preferably, the red LED 126 is always on when half a protocol is started and is not properly completed, the yellow LED 125 is always on when the worker is in the hall for a predetermined time period without sanitizing as a reminder to sanitize before or immediately after exiting a patient's room and the green LED 124 is always on when half a protocol is properly completed.

Turning to FIG. 8, each worker will preferably receive a monthly report or printout 320 of the positive and negative events recorded by the processor 75 for all workers performing within the system. As shown, the report 320 will indicate the month reported 321, the total number of patient room entries 322, the total number of completed hand hygiene protocol cycles 323 and the overall percentage of hand hygiene compliances 324. The report 320 may also anonymously rank the individual workers according to their respective percentage of the total of positive events for the reported month 321. As shown, each worker's unique credential 120 can be associated with a worker number 325 known only to that worker and the worker's supervisory personnel. Each worker's patient room entries 326, completed protocol cycles 327 and percentage of completed cycles 328 can be shown for personnel comparison of that worker's individual hand hygiene performance in relation to the performance of the group. Workers, or groups of workers, can be rewarded by use of suitable event redemption programs as may be deemed appropriate by the system manager. Overall rates of hand-hygiene compliance and rates of various nosocomial infections can be tracked, tallied and recorded to evaluate the success of the system.

Many additional features can be incorporated into or variations made in the system. For some users or in specific situations there may be a preference between use of soap or gel. For example, where *C. difficile* infections are a concern, use of soap and water is preferred to use of a gel. The system can be programmed to prohibit the proximity readers associated with gel dispensers from detecting the credentials 120 so as to force use of the soap dispenser to complete part of a protocol. Protocol sequences and time delays can be varied. An inside dispensing before exiting a patient's room may be counted as an outside dispensing before entering another patient's room if timely performed.

Thus, it is apparent that there has been provided, in accordance with the invention, a system, method and implementation for increasing the likelihood of hand hygiene in a desirably sanitary environment that fully satisfies the objects, aims and advantages set forth above. While the invention has been described in conjunction with specific embodiments, methods and implementations thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method for encouraging an exercise of hand hygiene by a worker in a desirably sanitary environment comprising the steps of:

issuing to the worker a unique credential to be transported with the worker;

equipping a hand hygiene station serving the desirably sanitary environment to dispense a hand hygiene substance upon demand by a worker transporting the unique credential;

monitoring a passageway of the desirably sanitary environment to sense the entry and exit of the unique credential into and from a room of the desirably sanitary environment; and determining a completion of a protocol cycle indicative of a dispensation of the hand hygiene substance to the worker transporting the unique credential for each entry and exit into and from the room of the desirably sanitary environment by the worker transporting the same unique credential.

2. A method for encouraging an exercise of hand hygiene by a worker in a desirably sanitary environment comprising the steps of:

issuing to the worker a unique credential to be transported with the worker;

equipping a hand hygiene station serving the desirably sanitary environment to dispense a hand hygiene substance upon demand by a worker transporting the unique credential;

monitoring a passageway of the desirably sanitary environment to sense the entry and exit of the unique credential into and from a room of the desirably sanitary environment, the hand hygiene station being inside the room; and determining a completion of a protocol cycle indicative of a dispensation of the hand hygiene substance to the worker transporting the unique credential for each entry and exit into and from the room of the desirably sanitary environment by the worker transporting the same unique credential, the protocol cycle comprising a sequential occurrence of an entry, a first dispensing, a second dispensing and an exit.

3. A method according to claim 2, the first dispensing occurring within a predetermined time after the entry and the second dispensing occurring within a predetermined time prior to the exit.

4. A method according to claim 3 further comprising the step of counting completed protocol cycles associated with the unique credential.

5. A method for encouraging an exercise of hand hygiene by a worker in a desirably sanitary environment comprising the steps of:

issuing to the worker a unique credential to be transported with the worker;

equipping a hand hygiene station serving the desirably sanitary environment to dispense a hand hygiene substance upon demand by a worker transporting the unique credential;

monitoring a passageway of the desirably sanitary environment to sense the entry and exit of the unique credential into and from a room of the desirably sanitary environment, the hand hygiene station being outside the room; and determining completion of a protocol cycle indicative of a dispensation of the hand hygiene substance to the worker transporting the unique credential for each entry and exit into and from the room of the desirably sanitary environment by the worker transporting the same unique credential, the protocol cycle comprising a sequential occurrence of a first dispensing, an entry, an exit and a second dispensing.

6. A method according to claim 5, the first dispensing occurring within a predetermined time prior to the entry and the second dispensing occurring within a predetermined time after the exit.

7. A method according to claim 6 further comprising the step of counting completed protocol cycles associated with the unique credential.

8. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential.

9. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of an entry, a first dispensing, a second dispensing and an exit for hand hygiene stations located inside a room of the desirably sanitary environment.

10. A method according to claim 9, the first dispensing occurring within a predetermined time after the entry and the second dispensing occurring within a predetermined time prior to the exit.

11. A method according to claim 10 further comprising the step of counting completed protocol cycles associated with each unique credential.

12. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of a first dispensing, an entry, an exit and a second dispensing for hand hygiene stations located outside rooms of the desirably sanitary environment.

13. A method according to claim 12, the first dispensing occurring within a predetermined time prior to the entry and the second dispensing occurring within a predetermined time after the exit.

14. A method according to claim 13 further comprising the step of counting completed protocol cycles associated with each unique credential.

15. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of an entry, a post-entry dispensing, a pre-exit dispensing and an exit for hand hygiene stations located inside a room of the desirably sanitary environment and a sequential occurrence of a pre-entry dispensing, an entry, an exit and a post exit dispensing for hand hygiene stations located outside a room of the desirably sanitary environment.

16. A method according to claim 15, the pre-entry dispensing occurring within a predetermined time prior to the entry, the post-exit dispensing occurring within a predetermined time after the exit, the post-entry dispensing occurring within a predetermined time after the entry and the pre-exit dispensing occurring within a predetermined time prior to the exit.

17. A method according to claim 16 further comprising the step of counting completed protocol cycles associated with each unique credential.

18. A method for encouraging exercise of hand hygiene by a worker in a desirably sanitary environment comprising the steps of:

issuing to the worker a unique credential to be transported with the worker;

equipping a hand hygiene station serving the desirably sanitary environment to dispense a hand hygiene substance upon demand by a worker transporting the unique credential;

monitoring a passageway of the desirably sanitary environment to sense the entry and exit of the unique credential into and from a room of the desirably sanitary environment, the hand hygiene station being inside the room; and determining a completion of a protocol cycle indicative of a dispensation of the hand hygiene substance to the worker transporting the unique credential for each entry and exit into and from the room of the desirably sanitary environment by the worker transporting the same unique credential, the protocol cycle comprising a sequential occurrence of an entry, a first dispensing, an exit and a second dispensing.

19. A method according to claim 18, the first dispensing occurring within a predetermined time after the entry and the second dispensing occurring within a predetermined time after the exit.

20. A method according to claim 19 further comprising the step of counting completed protocol cycles associated with the unique credential.

21. A method for encouraging an exercise of hand hygiene by a worker in a desirably sanitary environment comprising the steps of:

issuing to the worker a unique credential to be transported with the worker;

equipping a hand hygiene station serving the desirably sanitary environment to dispense a hand hygiene substance upon demand by a worker transporting the unique credential;

monitoring a passageway of the desirably sanitary environment to sense the entry and exit of the unique credential into and from a room of the desirably sanitary environment, the hand hygiene station being outside the room; and determining completion of a protocol cycle indicative of a dispensation of the hand hygiene substance to the worker transporting the unique credential for each entry and exit into and from the room of the desirably sanitary environment by the worker transporting the same unique credential, the protocol cycle comprising a sequential occurrence of a first dispensing, an entry, a second dispensing and an exit.

22. A method according to claim 21, the first dispensing occurring within a predetermined time prior to the entry and the second dispensing occurring within a predetermined time prior to the exit.

23. A method according to claim 22 further comprising the step of counting completed protocol cycles associated with the unique credential.

24. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of an entry, a first dispensing, an exit and a second dispensing for hand hygiene stations located inside a room of the desirably sanitary environment.

25. A method according to claim 24, the first dispensing occurring within a predetermined time after the entry and the second dispensing occurring within a predetermined time after the exit.

26. A method according to claim 25 further comprising the step of counting completed protocol cycles associated with each unique credential.

27. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of a first dispensing, an entry, a second dispensing and an exit for hand hygiene stations located outside rooms of the desirably sanitary environment.

28. A method according to claim 27, the first dispensing occurring within a predetermined time prior to the entry and the second dispensing occurring within a predetermined time prior to the exit.

29. A method according to claim 28 further comprising the step of counting completed protocol cycles associated with each unique credential.

30. A method for encouraging exercises of hand hygiene by workers in a desirably sanitary environment comprising the steps of:

issuing to each of the workers a unique credential to be transported with the workers;

equipping hand hygiene stations serving the desirably sanitary environment to individually dispense a hand hygiene substance upon demand by any worker transporting one of the issued unique credentials;

monitoring the passageways of the desirably sanitary environment to sense the entry and exit of any issued unique credential into and from rooms of the desirably sanitary environment; and determining a completion of a protocol cycle indicative of a dispensation of the hand hygiene substance upon demand by any worker transporting the unique credential for each entry and exit into and from rooms of the desirably sanitary environment by the worker transporting the same unique credential, the protocol cycle comprising a sequential occurrence of an entry, a post-entry dispensing, an exit and a post-exit dispensing for hand hygiene stations located inside a room of the desirably sanitary environment and a sequential occurrence of a pre-entry dispensing, an entry, a pre exit dispensing and an exit for hand hygiene stations located outside a room of the desirably sanitary environment.

31. A method according to claim 30, the post-entry dispensing occurring within a predetermined time after the entry, the post-exit dispensing occurring within a predetermined time after the exit, the pre-entry dispensing occurring within a predetermined time prior to the entry and the pre-exit dispensing occurring within a predetermined time prior to the exit.

32. A method according to claim 31 further comprising the step of counting completed protocol cycles associated with each unique credential.

* * * * *